US011024988B2

(12) United States Patent
Koellmann

(10) Patent No.: US 11,024,988 B2
(45) Date of Patent: Jun. 1, 2021

(54) CONDUCTOR TERMINAL WITH SHEET METAL PART HAVING ARCHED ROOT AREA FROM WHICH CLAMPING SPRING EXTENDS

(71) Applicant: WAGO Verwaltungsgesellschaft mbH, Minden (DE)

(72) Inventor: Hans-Josef Koellmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 143 days.

(21) Appl. No.: 16/290,072

(22) Filed: Mar. 1, 2019

(65) Prior Publication Data

US 2019/0199011 A1 Jun. 27, 2019

Related U.S. Application Data

(63) Continuation of application No. PCT/EP2017/071541, filed on Aug. 28, 2017.

(30) Foreign Application Priority Data

Sep. 2, 2016 (DE) ..... 10 2016 116 510.7

(51) Int. Cl.
*H01R 4/48* (2006.01)
*H01R 13/506* (2006.01)
(Continued)

(52) U.S. Cl.
CPC ..... *H01R 4/4818* (2013.01); *H01R 4/70* (2013.01); *H01R 9/2416* (2013.01); *H01R 13/506* (2013.01)

(58) Field of Classification Search
CPC ..... H01R 4/4818; H01R 9/2416; H01R 4/70
(Continued)

(56) References Cited

U.S. PATENT DOCUMENTS 2,713,668 A * 7/1955 Gibilisco ..... H01R 4/4836 439/438
2,720,634 A * 10/1955 Hart ..... H01R 4/4836 439/441
(Continued)

FOREIGN PATENT DOCUMENTS

CN 202888496 U 4/2013
DE 4003701 A1 8/1991
(Continued)

OTHER PUBLICATIONS

International Search Report dated Mar. 6, 2018 in corresponding application PCT/EP2017/071541.

*Primary Examiner* — Abdullah A Riyami
*Assistant Examiner* — Marcus E Harcum
(74) *Attorney, Agent, or Firm* — Muncy, Geissler, Olds & Lowe, P.C.

(57) ABSTRACT

A conductor terminal for clamping an electrical conductor having an insulating material housing and a contact element. The contact element includes a sheet metal part with at least one clamping spring arranged therein. The insulating material housing has at least one insertion guide channel leading towards a respective clamping spring. An opening is provided in the sheet metal part for receiving an electric conductor introduced into an associated insertion guide channel. The insulating material housing has a channel side wall that defines the insertion guide channel and extends into the opening.

16 Claims, 12 Drawing Sheets

(51) Int. Cl.
*H01R 9/24* (2006.01)
*H01R 4/70* (2006.01)

(58) Field of Classification Search
USPC ..... 439/212, 436–439, 441
See application file for complete search history.

(56) References Cited

U.S. PATENT DOCUMENTS 3,945,711 A * 3/1976 Hohorst ..... H01R 4/4818 439/723
4,397,514 A * 8/1983 Durand ..... H01R 4/4818 439/436
5,098,316 A 3/1992 Köllmann et al.
5,454,730 A * 10/1995 Tozuka ..... H01R 4/4818 439/438
5,975,940 A * 11/1999 Hartmann ..... H01R 4/4818 439/441
6,039,597 A * 3/2000 Getselis ..... F21S 8/00 439/439
6,132,238 A 10/2000 Hartmann et al.
6,746,286 B2 * 6/2004 Blaha ..... H01R 4/4809 439/436
6,832,938 B2 * 12/2004 Lenker ..... H01R 4/4836 439/441
7,507,106 B2 * 3/2009 Keswani ..... H01R 4/4818 439/439
7,722,384 B2 * 5/2010 Breen, IV ..... H01R 4/22 439/441
7,794,268 B2 * 9/2010 Breen, IV ..... H01R 11/09 439/441
7,896,686 B2 * 3/2011 Hoppe ..... H01R 4/4827 439/441
7,972,166 B2 * 7/2011 Hiner ..... H01R 13/5216 439/441
8,187,023 B1 * 5/2012 Chen ..... H01R 4/22 439/441
9,105,991 B1 8/2015 Bliss
2007/0259574 A1 * 11/2007 Kirstein ..... H01R 43/16 439/839
2008/0311802 A1 * 12/2008 Keswani ..... H01R 4/22 439/863
2011/0076900 A1 * 3/2011 Keswani ..... H01R 4/4818 439/787
2012/0208394 A1 * 8/2012 Tseng ..... H01R 11/11 439/438
2013/0157520 A1 * 6/2013 Koellmann ..... H01R 4/4836 439/834
2017/0373406 A1 * 12/2017 Ahldag ..... H01R 4/4818
2019/0036236 A1 * 1/2019 Ishikawa ..... H01R 4/4818

FOREIGN PATENT DOCUMENTS

DE 19654523 A1 7/1998
DE 20303537 U1 6/2003
DE 102006010309 A1 9/2007
DE 102012219741 A1 4/2014
EP 1855353 A2 11/2007

* cited by examiner

CONDUCTOR TERMINAL WITH SHEET METAL PART HAVING ARCHED ROOT AREA FROM WHICH CLAMPING SPRING EXTENDS

This nonprovisional application is a continuation of International Application No. PCT/EP2017/071541, which was filed on Aug. 28, 2017, and which claims priority to German Patent Application No. 10 2016 116 510.7, which was filed in Germany on Sep. 2, 2016, and which are both herein incorporated by reference.

BACKGROUND OF THE INVENTION

Field of the Invention

The present invention relates to a conductor terminal for clamping an electric conductor, which comprises an insulating material housing and a contact element, the contact element having a sheet metal part with at least one clamping spring arranged thereon. The insulating material housing has at least one insertion guide channel leading to a particular clamping spring. An opening is present in the sheet meal part for receiving an electric conductor inserted into an associated insertion guide channel. The invention also relates to a conductor terminal comprising a sheet metal part and at least one clamping spring protruding from the sheet metal part, which is connected to the sheet metal part in a root area of the sheet metal part.

Description of the Background Art

Conductor terminals are known, for example, in the form of a socket terminal, in which multiple electric conductors are electrically conductively connected to each other with the aid of a shared contact element.

EP 1 855 353 B1, which is incorporated herein by reference, describes a conductor terminal comprising a spring steel sheet and a busbar mounted in this spring steel sheet. The clamping points for clamping an electric conductor are each formed between the free ends of leaf spring tongues and the busbar. The leaf spring tongues are cut away from the spring steel sheet in such a way that their tongue roots are fixedly connected to the upper edge area of the spring steel sheet. The busbar is inserted into a V-shaped receiving space. The length of the leaf spring tongues are dimensioned in such a way that their tongue ends pass through the window recess of the spring steel sheet when the clamping point is closed and unoccupied and abut the underside of the busbar.

DE 40 03 701 A1, which corresponds to U.S. Pat. No. 5,098,316, which is incorporated herein by reference, shows an equipment terminal comprising a contact application sheet, which is bent in the shape of a V in the direction of the clamping limb section, forming a hollow. This forms a molded surface of the contact application sheet, which represents one lateral half of a socket part of a plug connection integrated into the equipment terminal.

DE 196 54 523 A1, which corresponds to U.S. Pat. No. 6,132,238, discloses a conductor terminal, which is formed from a busbar rod and a spring steel sheet, from which leaf springs are stamped in the manner of tongues, whose stamped-out tongue ends are oriented opposite the busbar rod.

SUMMARY OF THE INVENTION

It is therefore an object of the present invention to provide an improved conductor terminal, which improves, in particular, the clamping of multi-wire conductors.

In an exemplary embodiment, it is proposed that the insulating material housing can have channel side walls which delimit the insertion guide channel and extend into the opening. Due to the fact that the channel side walls now protrude into the opening of the sheet metal part, an improved guidance, in particular of multiwire conductors through the opening is facilitated. The strands are held together beyond the clamping point with the aid of these channel side walls. When clamping an electric conductor, a displacement of the strands is prevented, for example due to an application of force by the clamping spring, or at least the risk of displacement is reduced, in that the channel side walls provide a lateral guidance of the electric conductor to be clamped beyond the clamping point in the conductor insertion direction.

The sheet metal part may be bent in the area of the opening. The channel side walls then pass through the opening in the bent section of the sheet metal part. This facilitates a highly compact specific embodiment of the conductor terminal and a good guidance of the conductor.

Two channel side walls, which are spaced a distance apart, disposed at a distance from each other and inserted into the opening, may be present for each insertion guide channel. This makes it possible to guide the conductor on both sides.

The channel side walls may be T-shaped in cross section, in particular for the outer channel side walls, or they may be H-shaped in cross section, i.e. having a double T shape. These H-shaped channel side walls in cross section may be provided, in particular for the insertion guide channels situated side by side. These T- and H-shaped cross sections increase the stability of the channel side walls in a compact design.

Alternatively or in combination with this approach, it is proposed that the sheet metal part is arched in the root area. The arch has a groove base of a groove of the arch oriented transversely to the main extension direction of the clamping spring. This arch is present not only in the area of the tongue root of the clamping spring tongue but is also situated in the adjacent part of the sheet metal part, which transitions into side webs delimiting the opening. The spring elasticity of the clamping spring after stamping is improved with the aid of this arch. The clamping spring is namely first bent back against the spring force of the clamping spring in the arch and then elastically deformed. The length of the clamping spring may be shortened thereby, or a conductor terminal having a very low height may be implemented. When inserting a multiwire conductor in particular, the arch furthermore results in the fact that the conductor strikes the elastic part of the clamping spring, so that the clamping spring is already elastically deformed when the electric conductor is inserted. This reduces the risk of strands of a multiwire conductor becoming displaced, compared to a conductor terminal without an arch of this type. This is also achieved in that, due to the arch, the spring elasticity of the sheet metal part is increased in the root area of the sheet metal part, and the latter is spring-elastically deformable, together with the side webs, when an electrical conductor is clamped.

The middle extension of the clamping spring from the root area of the clamping spring to the clamping end of the clamping spring is viewed as the main extension direction of the clamping spring. The main extension direction of the clamping spring may be defined by the area of the clamping spring situated in the insertion guide channel between the root area and the supporting section of the sheet metal part. However, it is also conceivable that the main extension direction of the clamping spring is defined exclusively by the area of the clamping spring delimited by the side web and the supporting section of the sheet metal part in the insertion guide channel.

The sheet metal part can be provided with two arches in the root area. These two arches may abut each other and be formed counter to each other, i.e. in the shape of an S. This intensifies the elastic effect of the clamping spring. The second arch may abut the first arch essentially in the direction of the clamping end of the clamping spring. In the main extension direction of the clamping spring, a kind of parallelism of the course of the clamping spring occurs with respect to the transverse web or the surface of the transverse web facing the conductor insertion area, due to this S-shaped design. The course of the main extension direction of the clamping spring is essentially located in the insertion guide channel, i.e. in the area between the supporting section and the side web or the root area of the clamping spring.

The first arch and the second arch may thus be designed in such a way that, in the non-deflected state of the clamping spring, the main extension direction of the clamping spring is oriented in parallel, i.e. approximately in parallel +/−10°, to the surface of a transverse web of the sheet metal part abutting the root area or to the transverse orientation of the transverse web at right angles to the longitudinal extension direction of the transverse web or the lined-up direction of the clamping springs.

The groove of the first arch may be situated on the side of the sheet metal part which is opposite the side of the sheet metal part from which the clamping spring protrudes.

The at least one clamping spring may be formed as a single piece from the material of the sheet metal part. The clamping spring is then released from the sheet metal part (e.g. cut out or stamped out) and is bent away from the plane of the sheet metal part. An opening is then present in the plane of the sheet metal part. This opening is the window that remains due to the removal of the clamping spring from the sheet metal part and which is delimited by two side webs.

In this way, a highly material-conserving conductor terminal may be provided, in which the sheet metal part, together with the clamping spring formed therefrom, contributes to the spring-elastic clamping of an electric conductor.

The sheet metal part may carry an electrically conductive busbar opposite the free end of the clamping spring. The provision of a separate busbar of this type, on which the electric conductor rests and is clamped due to the spring force of the clamping spring, has the advantage that an improved current transfer may be ensured by selecting another electrically conductive material, e.g. having a higher copper content. Alternatively, the clamping point may also be formed between the clamping spring and a web of the sheet metal part opposite the clamping spring.

The conductor terminal may have an insulating material housing comprising a housing part, in which the sheet metal part is accommodated. The housing part is then closed by a cover part, which may engage, for example, with the housing part. The cover part then has at least one insertion guide channel leading to a particular clamping spring.

The channel side walls can be formed on a cover part.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
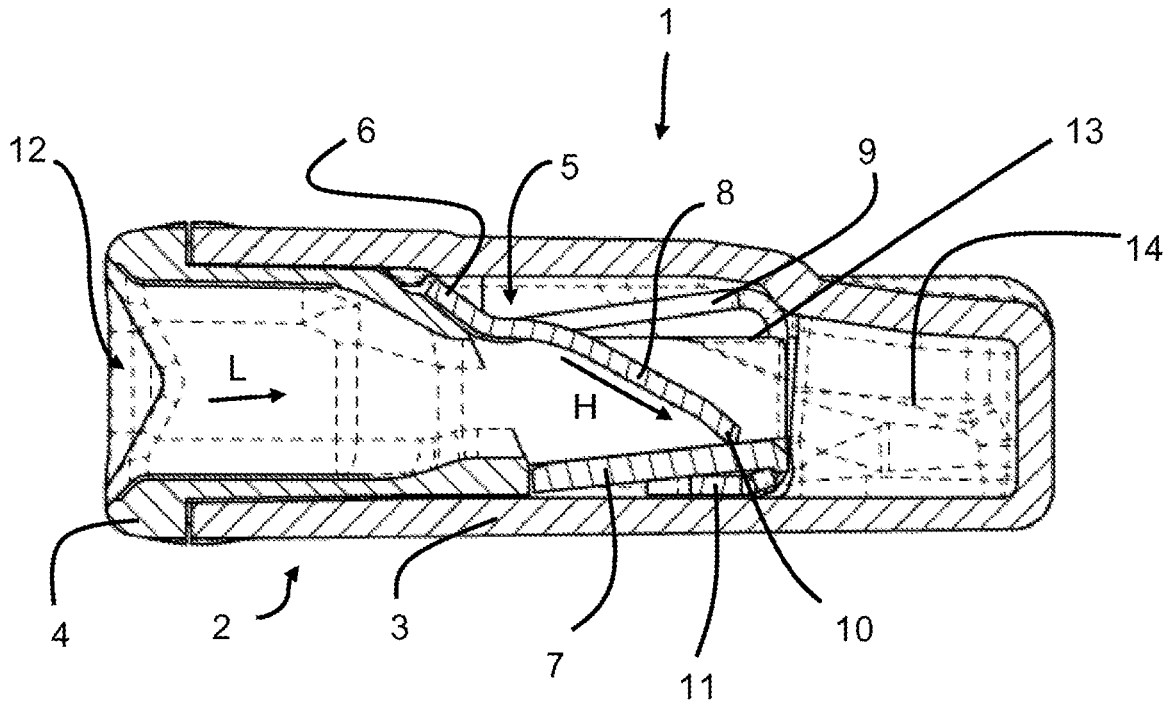
FIG. 1 shows a sectional side view of an embodiment of a conductor terminal.

FIG. 1 shows a sectional side view of a first, single-row conductor terminal 1 for clamping electric conductors. Conductor terminal 1 has an insulating material housing 2, which is formed from a housing part 3 and a cover part 4, which closes housing part 3 on the front side. Cover part 4 is inserted into housing part 3 and is engaged therewith. A contact element 5, which has a sheet metal part 6 and a busbar 7, is introduced into housing part 3. Sheet metal part 6 has a clamping spring 8, which is released from sheet metal part 6 (e.g. cut out or stamped out) and is bent away from the plane of sheet metal part 6. By bending away clamping spring 8, an opening delimited by side webs 9 remains in sheet metal part 6. The freely movable end of clamping spring 8 forms a clamping end, which rests upon busbar 7, e.g. in the unoccupied idle state, and together with busbar 7 forms a clamping point for clamping an electric conductor clamped between clamping end 10 and busbar 7.

It is clear that the sheet metal part is bent in the shape of a U and has a supporting section 11 for busbar 7 adjacent to clamping end 10.

Cover part 4 has an insertion guide channel 12, which is delimited by channel side walls 13. Channel side walls 13 of cover part 4 extend laterally beyond clamping spring 8 into the opening of sheet metal part 6. Channel side walls 13 may project behind sheet metal part 6 in conductor insertion direction L and protrude into a conductor capture pocket 14. However, they may also end at side webs 9 of sheet metal part 6. In this way, a lateral guidance of an electric conductor to be clamped beyond the clamping point is provided. In addition, clamping spring 8 is centered and laterally guided.

Figure 2:
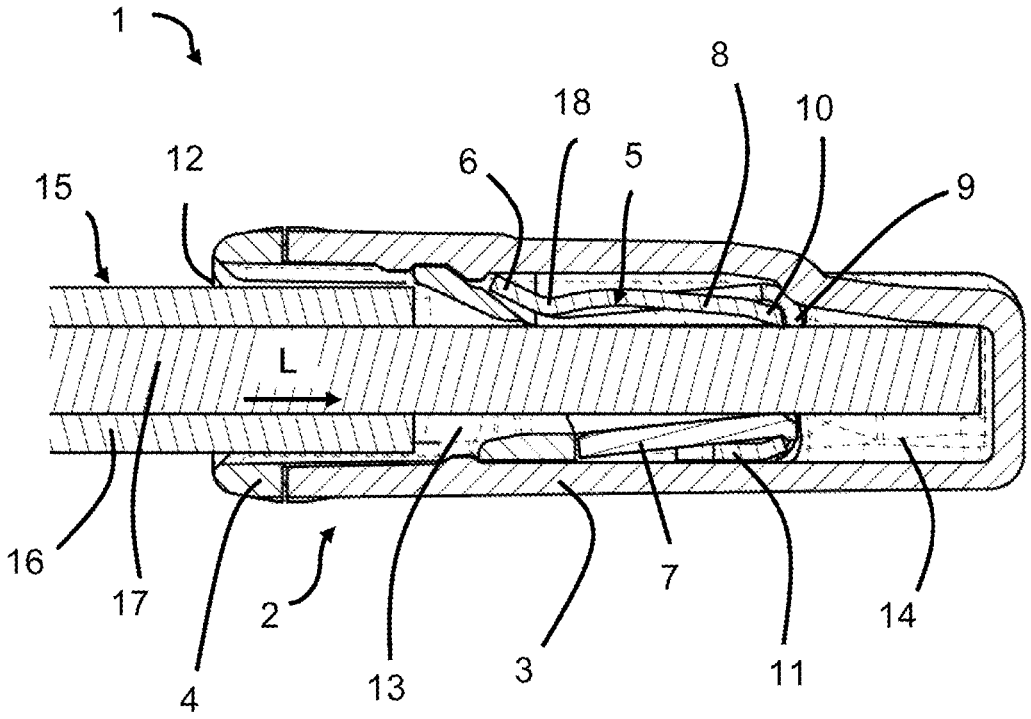
FIG. 2 shows the sectional side view from FIG. 1, including a clamped electric conductor.

Conductor terminal 1 from FIG. 1 is now apparent in FIG. 2, in this case including an inserted and clamped electric conductor 15. This electric conductor 15 has an insulating material sheath 16, which surrounds electrically conductive conductor core 17. The stripped end of electric conductor 15 is guided through the opening delimited by side webs 9 of sheet metal part 6 laterally along channel side walls 13 and dips into conductor capture pocket 14. It is apparent that clamping spring 8 is now displaced away from busbar 7 and rests with its clamping edge 10 on electric conductor 15. Electric conductor 15 rests with its stripped end on the side of busbar 7 which is diametrically opposed to clamping edge 10. Electric conductor 15 is pressed against busbar 7 by the spring force of clamping spring 8, and electric conductor 15 is prevented from being pulled out by sharp-edged clamping edge 10 of clamping spring 8.

It is clear that clamping spring 8 has a convex arch in root area 18, i.e. in the transition to frame-like sheet metal part 6, in this clamping position of busbar 7. Root area 18 having this arched section greatly contributes to the spring elasticity and to the application of the necessary spring force.

Compared to FIG. 1, it is also clear that sheet metal part 6 with its root area 18 is bent slightly farther away from opposite busbar 7. Root area 18, including abutting side webs 9, also noticeably contributes to the spring elasticity.

Opposite root area 18, sheet metal part 6 is folded over with two bends spaced a distance apart in such a way that side webs 9, which delimit the opening, extend transversely (90 degrees+/−10 degrees) to the longitudinal extension direction of clamped electric conductor 15. Clamping end 10 of clamping spring 8 moves out of the idle position (FIG. 1) into the clamping position (FIG. 2) upstream from this horizontal section of side webs 9, viewed in conductor insertion direction L.

It is also clear that clamping spring 8 extends in a main extension direction H, which is defined by the middle orientation of clamping spring 8 in insertion guide channel 12 in the area of clamping spring 8 delimited by side web 9 and supporting section 11 of sheet metal part 6.

Figure 3:
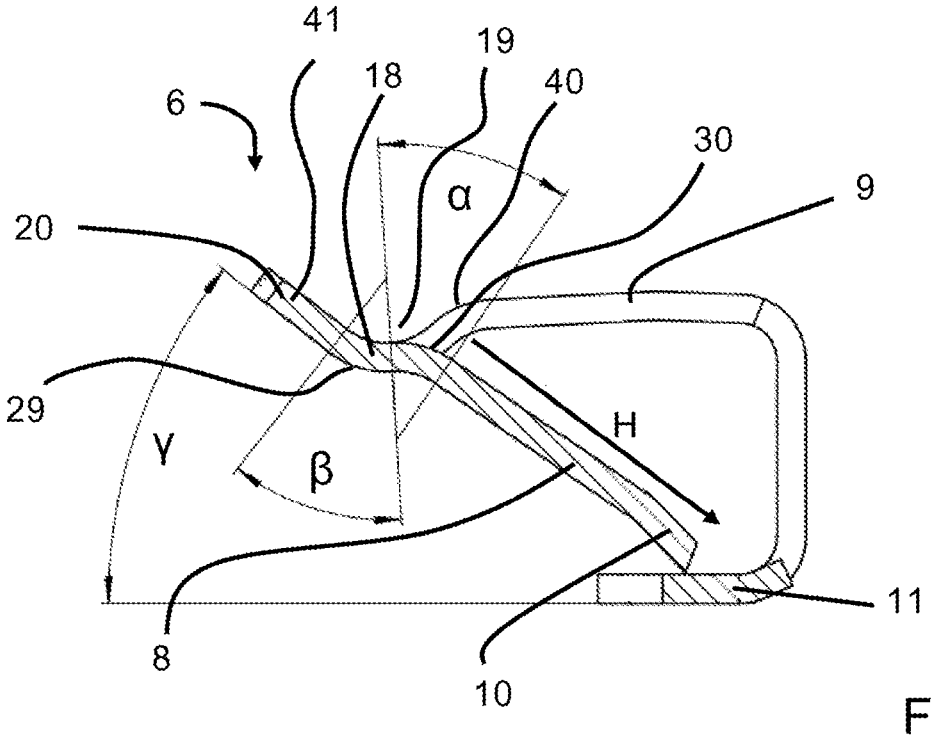
FIG. 3 shows a sectional side view of a contact element for the terminal conductor from FIGS. 1 and 2.

FIG. 3 shows a sectional side view of sheet metal part 6. Clamping spring 8 is in the idle state, in which sharp-edged clamping end 10 rests on supporting section 11.

It is clear that sheet metal part 6 is arched in root area 18, i.e. in the transition from transverse web 20 to clamping spring 8. This arch is S-shaped, i.e. it is made up of first arch 29 and a second arch 30, which is formed in the opposite direction. At least one of these arches 29, 30 has a groove 19, whose groove base is oriented transversely to main extension direction H of clamping spring 8. First arch 29 is not only present on clamping spring 8 but also on adjacent side webs 9. A third arch 40 is present in the transition between transverse web 20 and side webs 9. First and third arches 29, 40 are also S-shaped, i.e. oriented in opposite directions from each other.

Clamping spring 8 is first bent in root area 18 at angle α in the idle state, starting from clamping end 10, and then bent at angle ß. These two bending radii a and ß are different. Angle α may have, for example, an angle in the area of 38 degrees+/−2 degrees, and angle ß may have an angle of 41.5 Grad+/−1 degree.

Adjacent to clamping spring 8, side web 9 is first bent downward once in the direction of the plane of support leg 11 and then curved. This curvature angle may be greater than 90 degrees and should be in the area of approximately 120 degrees+/−20 degrees.

When releasing clamping spring 8 (e.g. spring tongue), for example by stamping, the necessary stabilization of clamping spring 8 in root area 18 is achieved by this described arch. Bending clamping spring 8 back at illustrated bending angles α, ß results in an elastic predeformation, which improves the spring forces of clamping spring 8 and makes it possible to shorten clamping spring 8. This makes it possible to implement a conductor terminal 1 having a very low height. In addition, an inserted electric conductor 15 strikes clamping spring 8 only in a released area of sheet metal part 6 through a slit in remaining sheet metal part 6, the clamping spring then yielding in a spring-elastic manner upon the striking of inserted electric conductor 15.

It is furthermore apparent that transverse web 20 of sheet metal part 6 abutting root area 18 is inclined at an angle γ with respect to the plane of supporting section 11. This angle γ may be in the area of, for example, 38 degrees+/−2 degrees.

Transverse web 20 has a surface 41, which faces insertion guide channel 12. Surface 41 and main extension direction H of clamping spring 8 have an approximately parallel position with respect to each other. The transverse direction of transverse web 20 at right angles to its longitudinal extension direction and the main extension direction are essentially in parallel to each other.

It is furthermore apparent that main extension direction H of clamping spring 8 is situated between root area 18 and supporting section 11 of sheet metal part 6 in the area of insertion guide channel 12, i.e. of the conductor receptacle.

Figure 4:
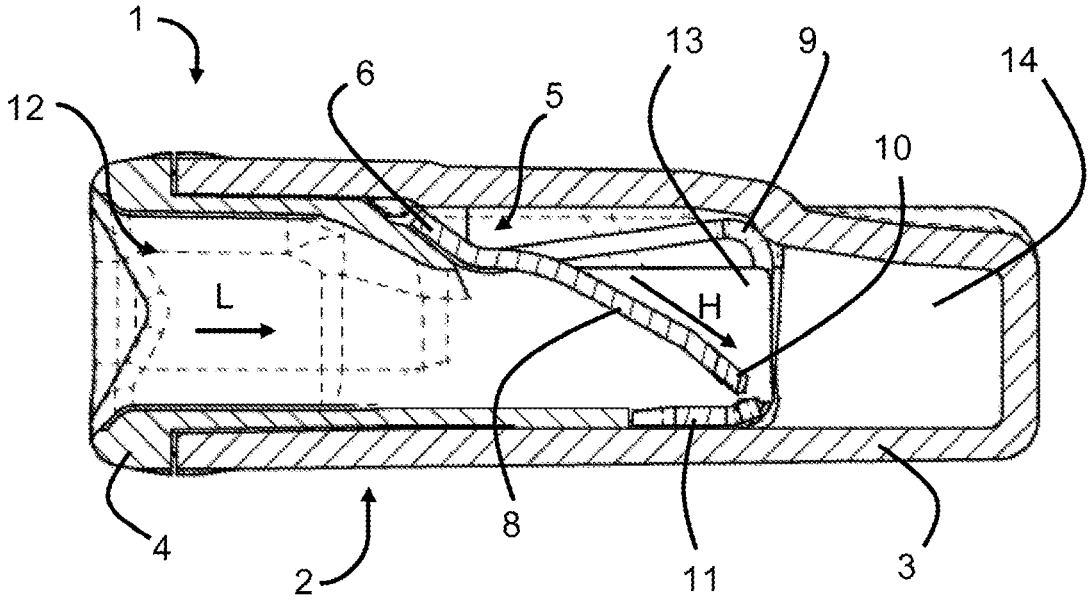
FIG. 4 shows a sectional side view of an embodiment of the conductor terminal.

A second specific embodiment of conductor terminal 1 is apparent in FIG. 4. Reference may essentially be made to the description of the first exemplary embodiment. In contrast thereto, contact element 5, however, includes only sheet metal part 6 without a separate additional busbar 7. Electric conductor 15 is clamped to supporting section 11 of sheet metal part 6 with the aid of clamping spring 8.

Figure 5:
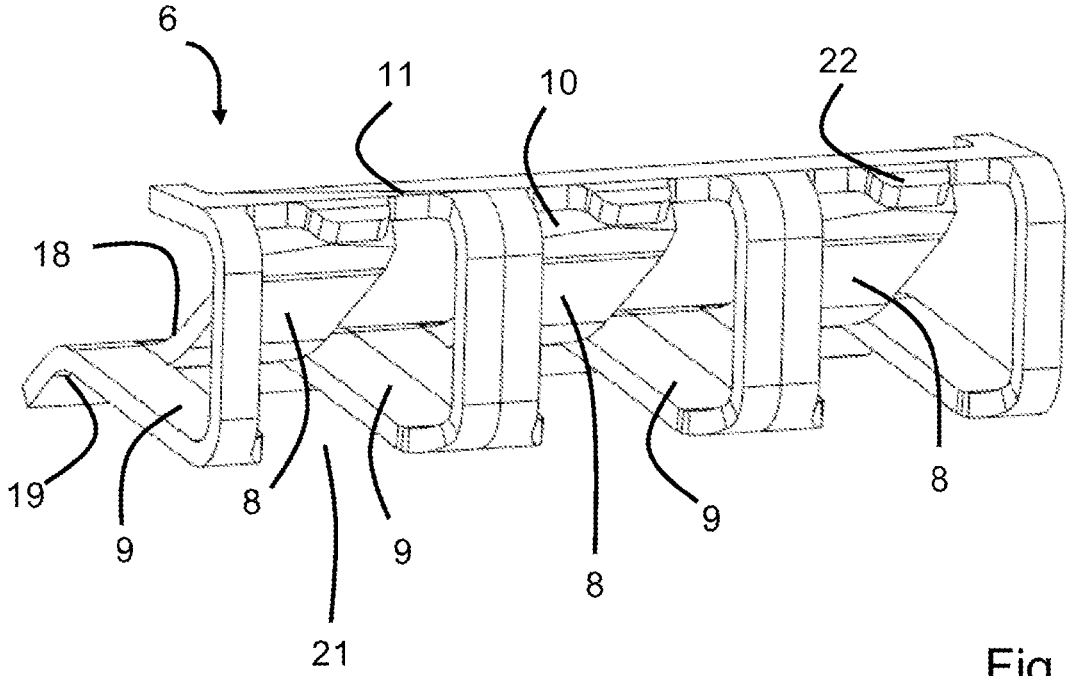
FIG. 5 shows a perspective view of the contact element from FIG. 3.

A perspective view of sheet metal part 6 of conductor terminals 1 described above is apparent in FIG. 5. It is clear that multiple clamping springs 8, situated side by side, are released from sheet metal part 6 and are bent away from the plane adjacent to particular root area 18 and spanned by side webs 9 toward opposite supporting section 11. It is clear that side webs 9 remaining due to the release of clamping spring 8 delimit an opening 21. Side webs 9 are bent at right angles to the plane of side webs 9 adjacent to root area 18 and then folded back against conductor insertion direction L together with supporting section 11. Clamping spring 8 (clamping tongue) is movable within a range, viewed in conductor insertion direction L, in front of the plane spanned by the vertical sections of side webs 9.

It is furthermore clear that supporting section 11 has a protruding nose 22 (material tab) behind particular clamping end 10 of clamping spring 8, viewed in conductor insertion direction L, on which busbar 7 may be supported. Busbar 7 may be held in a form-fitting manner in the intermediate space between these noses 22 and side webs 9.

Figure 6:
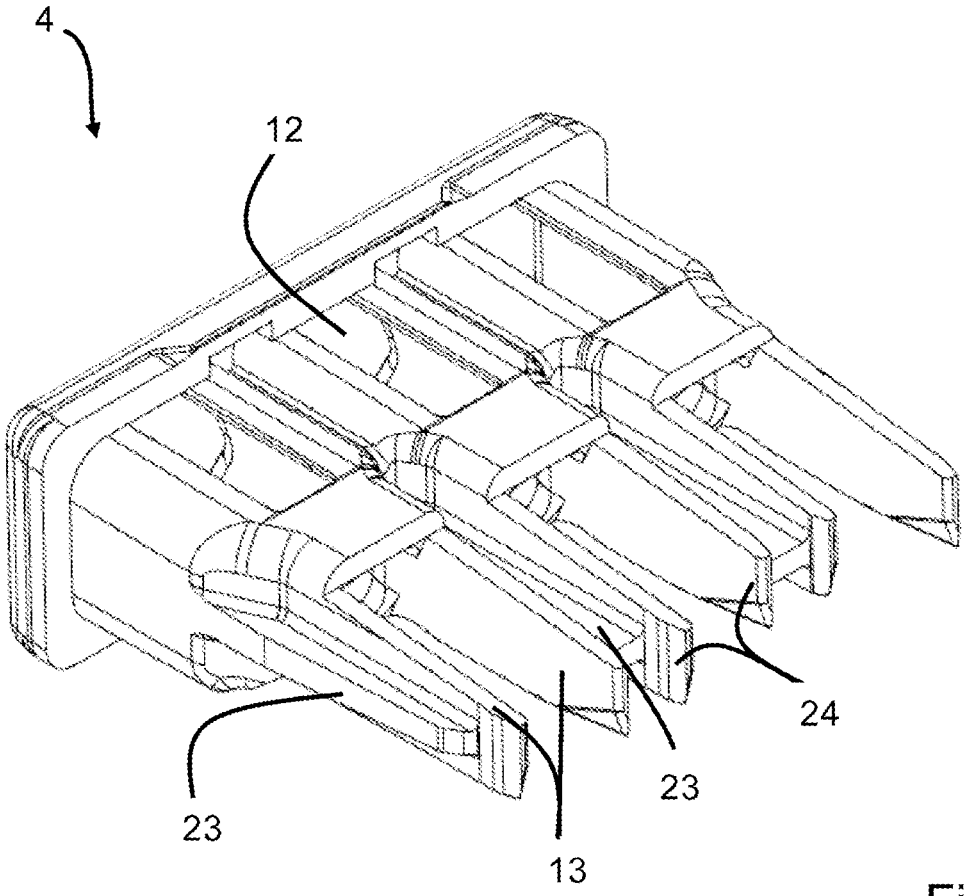
FIG. 6 shows a perspective view of the cover part of the conductor terminal from FIGS. 1, 2 and 4.

FIG. 6 shows a perspective view of cover part 4, including channel side walls 13, which laterally delimit a particular insertion guide channel 12. It is clear that two adjacent channel side walls 13 of insertion guide channels 12 arranged side by side are each connected to each other by a connecting web 23. Connecting web 23 then ends before narrower lugs 24, which are inserted into an opening in sheet metal part 6 delimited by a side web 9. Webs 9 are then positioned between lugs 24 connected to each other by connecting web 23 of cover part 4.

This cover part 4 is formed from a plastic material made from insulating material and has suitable latching elements for latching cover part 4 to housing part 3. It is clear that the two outer channel side walls 13 are T-shaped in cross section. The intermediate pairs of channel side walls 13, including connecting webs 23, are H-shaped, i.e. double T-shaped, in cross section. The observed cross section is in the main area behind lugs 24.

Figure 7:
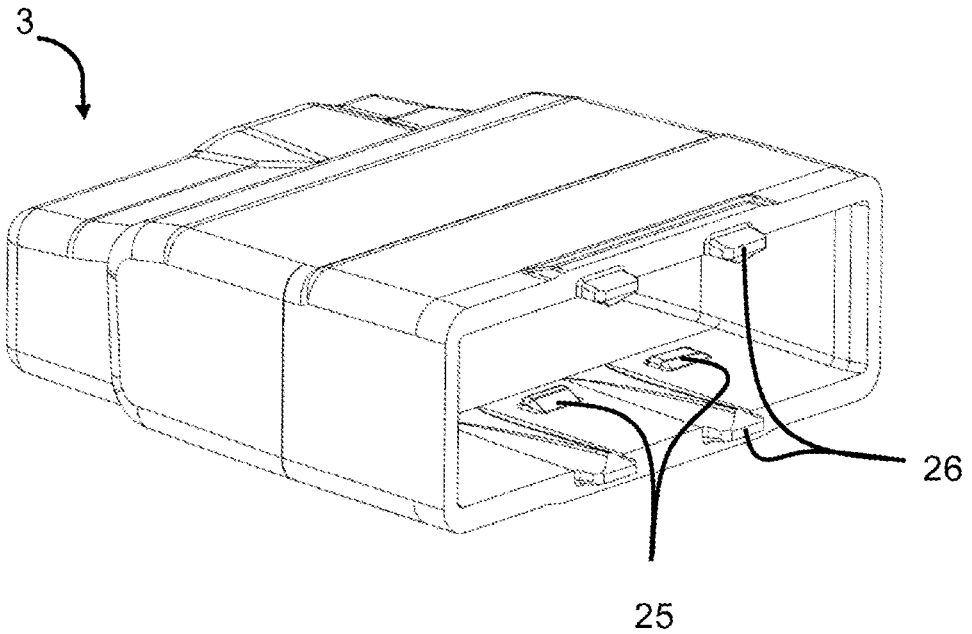
FIG. 7 shows a perspective front view of the housing part for the conductor terminal.

FIG. 7 shows a perspective front view of housing part 3 of single-row conductor terminal 1. It is clear that latching protrusions 25 are present on the inside of housing part 3, which are used to latch cover part 4. Latching tabs 26 also project from the end face of housing part 3, which dip into the corresponding latching opening of cover part 4. The contact element formed from sheet metal part 6 illustrated in FIG. 5 and possibly a busbar 7, is inserted into the interior of housing part 3. Housing part 3 is then closed by cover part 4 illustrated in FIG. 6.

Figure 8:
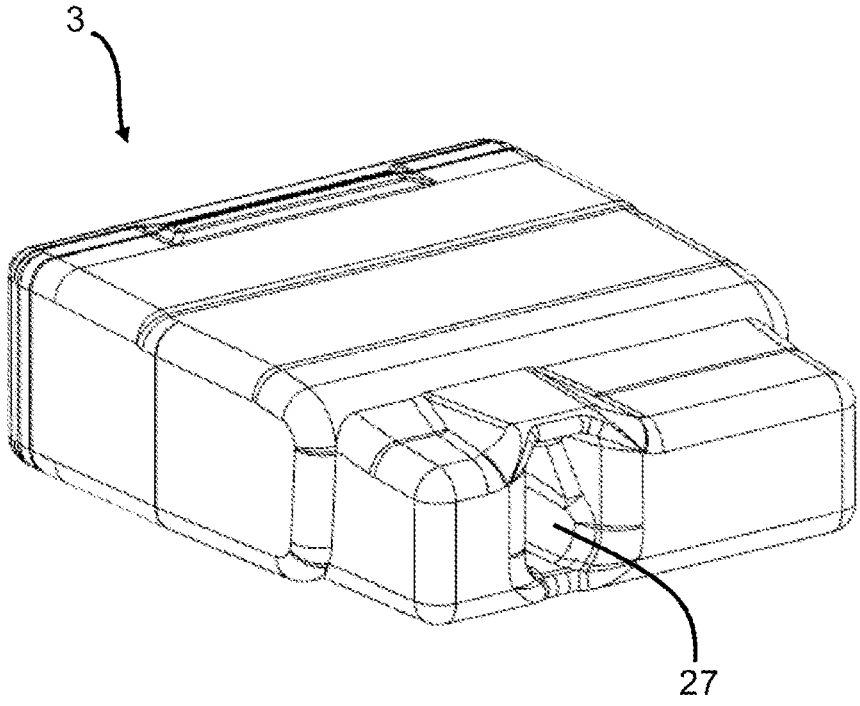
FIG. 8 shows a perspective rear view of the housing part of the conductor terminal.

FIG. 8 shows a perspective rear side view of housing part 3 from FIG. 7. It is clear that a test opening 27 is present on the back of housing part 3, which leads to side webs 9 of sheet metal part 6. The electrical potential present at the contact element may be measured by inserting an electrically conductive test tool.

Figure 9:
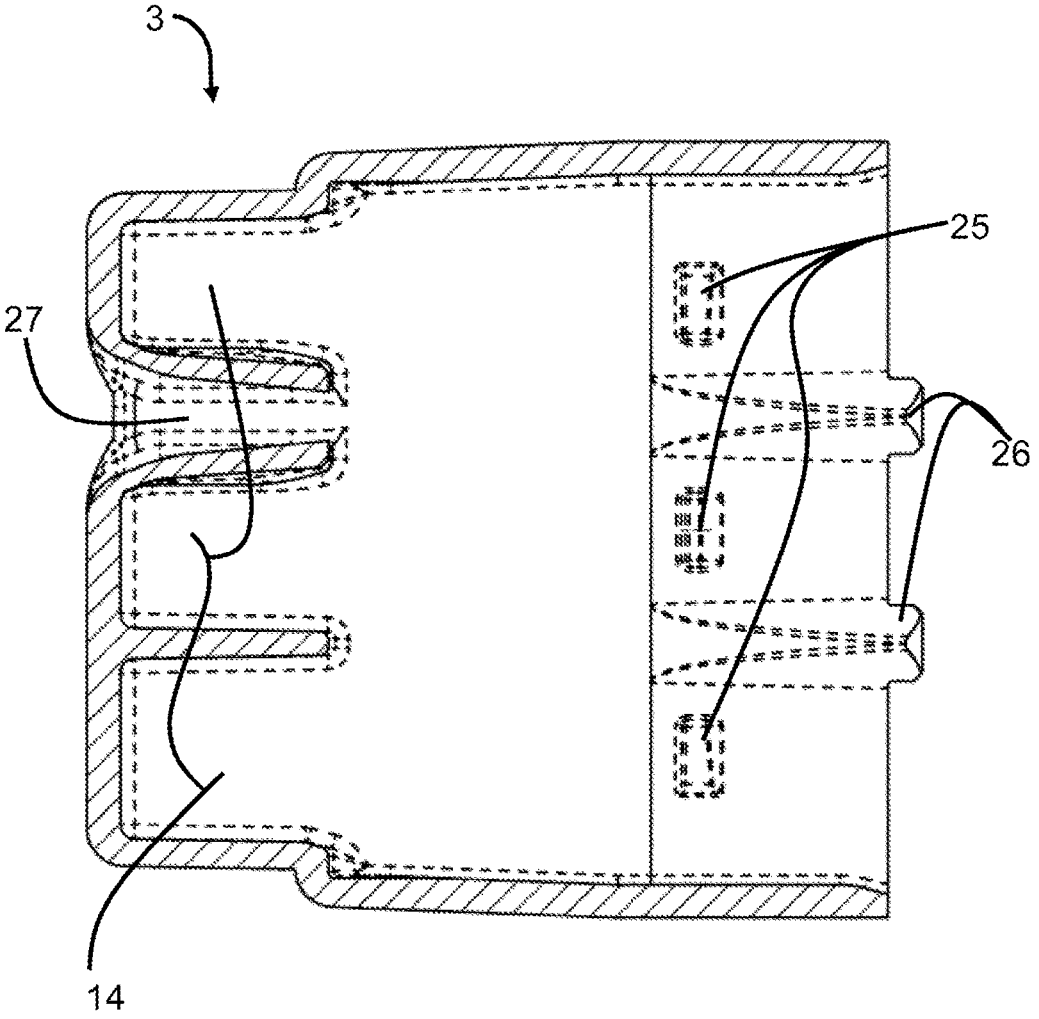
FIG. 9 shows a longitudinal sectional view of the housing part from FIG. 7.

FIG. 9 shows a longitudinal sectional view of housing part 3, viewed from above. It is clear that housing part 3 has multiple conductor capture pockets in the rear area, which are arranged side by side. Test opening 27, which leads into the interior of housing part 3, is also apparent.

Figure 10:
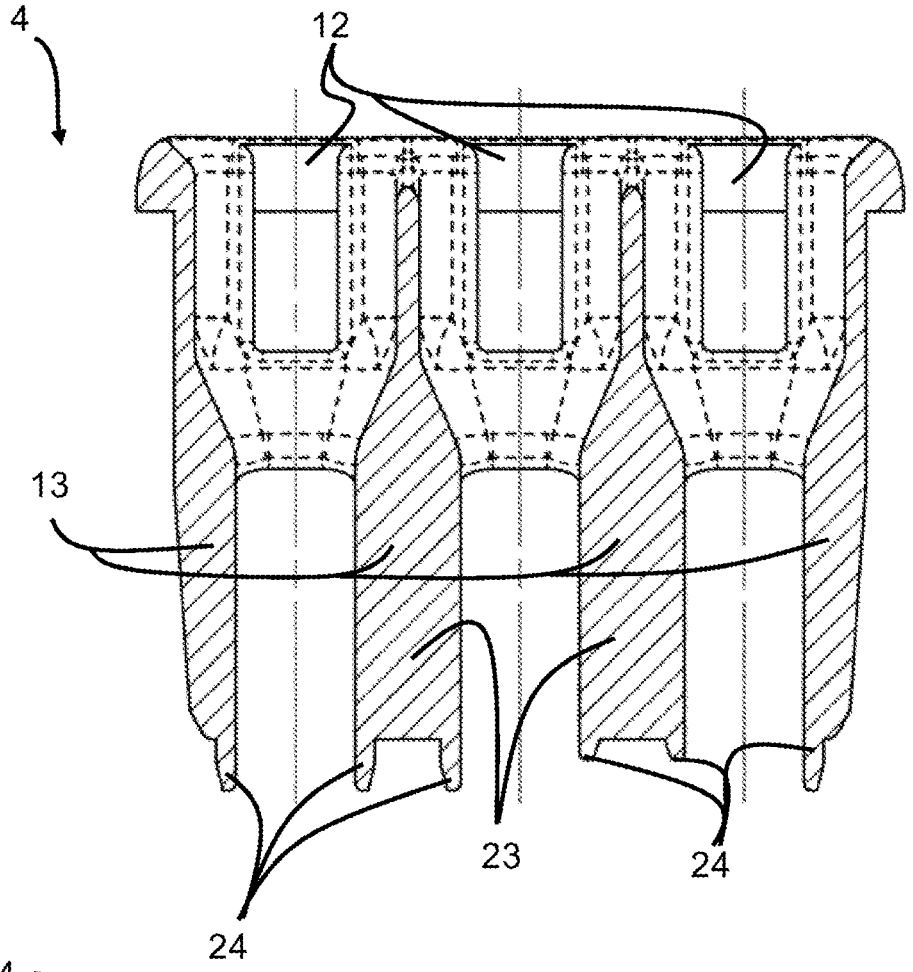
FIG. 10 shows a longitudinal sectional view of the cover part from FIG. 6.

FIG. 10 shows a longitudinal sectional view of cover part 4, viewed from above. It is clear that insertion guide channels 12 extend from the front side to the end of cover part 4. Insertion guide channels 12 first have an expanded section and then transition into a tapered section in a conically tapered manner. Insertion guide channels 12 are delimited by channel side walls 13, which extend farther beyond the conically tapering part and end in narrower lugs 24. The material thickness of channel side walls 13 expands from lugs 14 to the front side. Diametrically opposed channel side walls 13 of adjacent insertion guide channels 12 are each connected to each other to form a single piece by connecting webs 23. Since connecting web 23 and channel side walls 13 are formed from the same insulating material, channel side walls 13 and connecting webs 23 do not appear to be separate in the sectional representation but are visible as a widened section, including the channel side walls, on the opposite surfaces of this material section.

Figure 11:
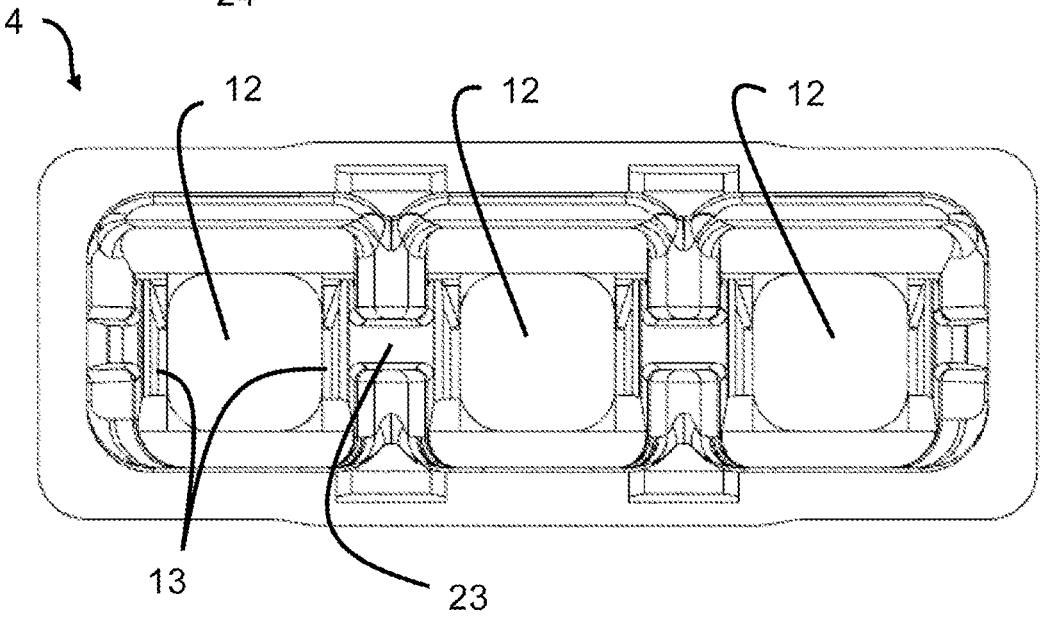
FIG. 11 shows a front view of the cover part from FIG. 6.

FIG. 11 shows a front view of cover part 4 with a view of insertion guide channels 12. It is clear that, in this cover part 4 for a three-pole conductor terminal 3, insertion guide channels 12 are arranged side by side and spaced a distance apart by channel side walls 13 with connecting web 23. Each insertion guide channel 12 leads to a clamping point formed by a clamping spring 8 and shared busbar 7 extending transversely to the extension direction of insertion guide channels 12 for the purpose of clamping an electric conductor 15 inserted into a particular insertion guide channel 12.

Figure 12:
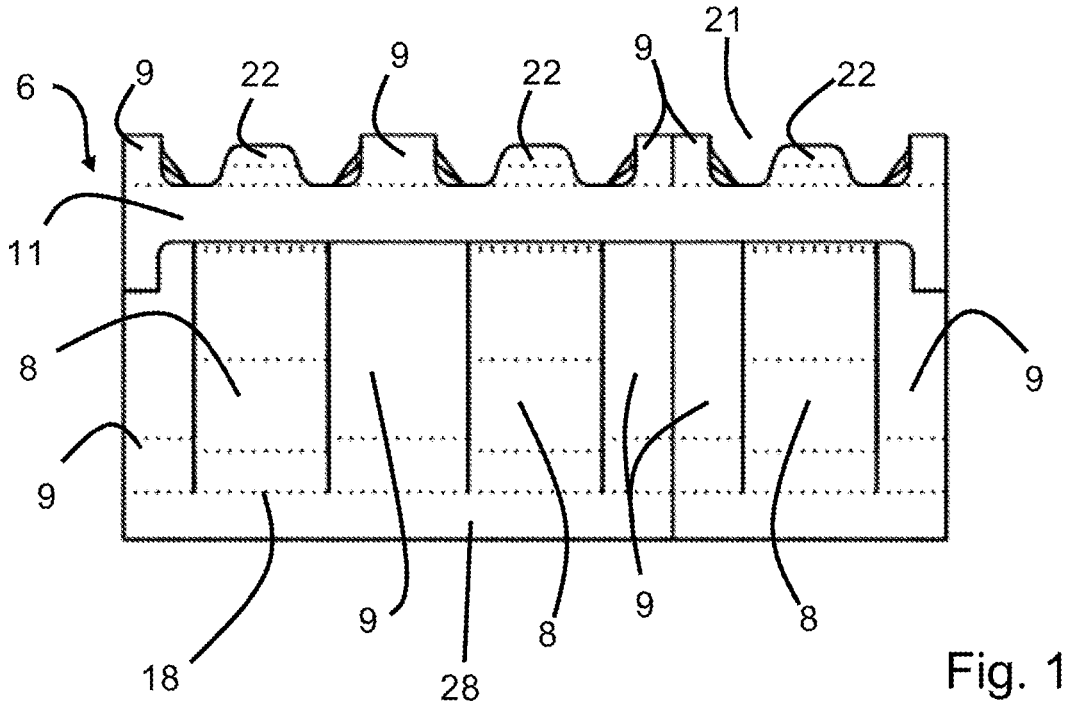
FIG. 12 shows a top view of the sheet metal part of the contact element from FIG. 5.

FIG. 12 shows a top view of sheet metal part 6 of conductor terminals 1 described above. It is clear that clamping springs 8 are cut out of sheet metal part 6, forming clamping tongues, while side webs 9 remain. These side webs 9 are connected to each other in the root area via a shared transverse web 28, so that sheet metal part 6 has a frame-like structure.

It is also clear that side webs 9 are folded upward at right angles in a vertical section and transition into supporting section 11. This supporting section 11 also includes a transverse web connecting side webs 9, on which noses 22 between side webs 9 are optionally arranged in particular opening 21.

Figure 13:
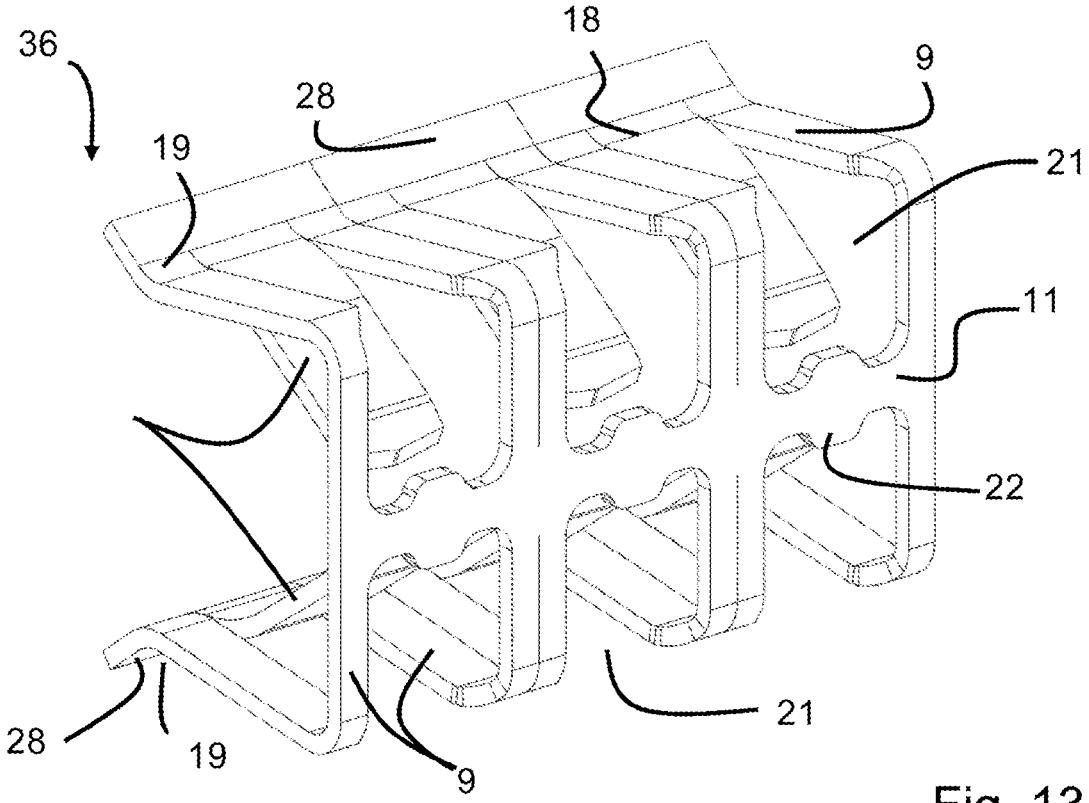
FIG. 13 shows a perspective view of an embodiment of a contact element for a two-row conductor terminal.

FIG. 13 shows another specific embodiment of a sheet metal part 36 for a two-row conductor terminal 31. Reference may essentially be made to the embodiments discussed above. In this specific embodiment, however, supporting section 11 is arranged in the plane of vertical opening 21 or vertical section of side webs 9 and connects two groups of clamping springs 8, which are connected to each other by a particular transverse web 28 and are arranged to mirror each other. Clamping tongues 8 of opposite groups of clamping springs 8 protrude diagonally toward each other and are oriented in the direction of supporting section 11.

The arch illustrated in FIG. 3 is present on both sides.

Figure 14:
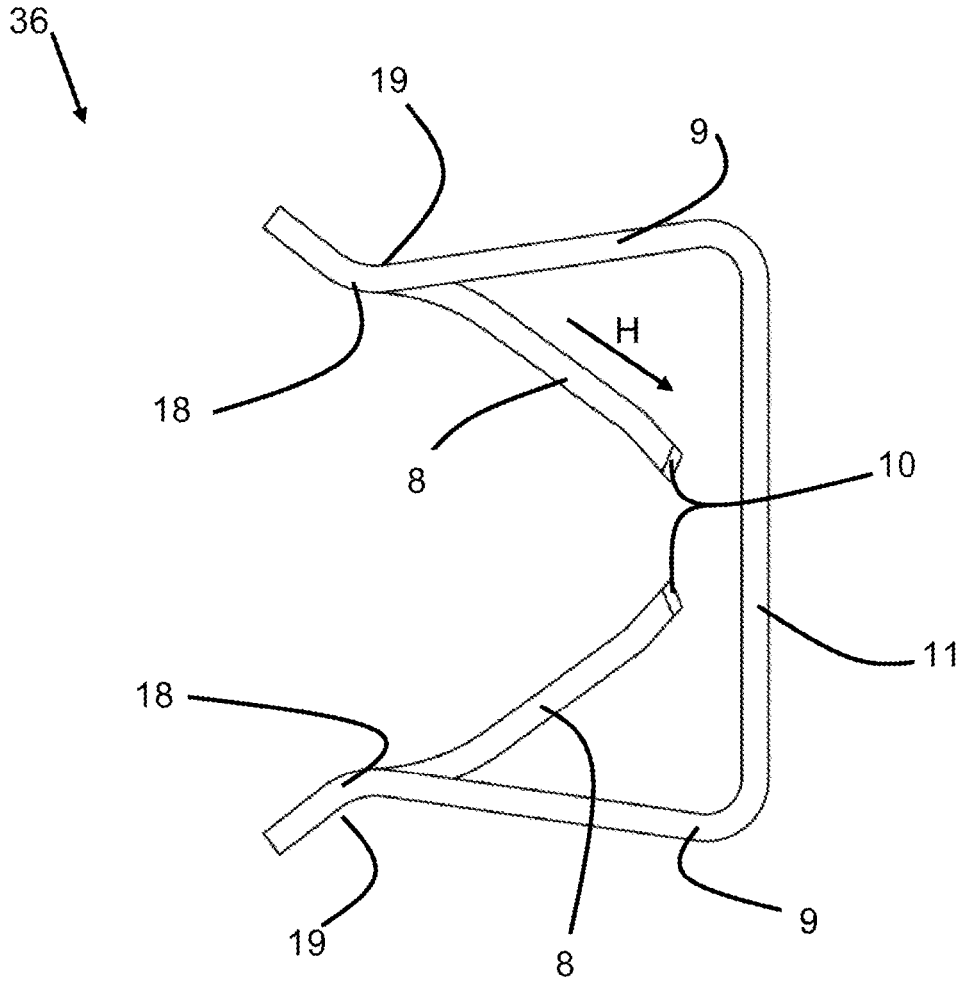
FIG. 14 shows a side view of the contact part from FIG. 13.

FIG. 14 shows a side view of sheet metal part 36 from FIG. 13. It is clear that in each case two clamping springs 8 are arranged one above the other and oriented toward central supporting section 11 in the vertical section of sheet metal part 36.

Figure 15:
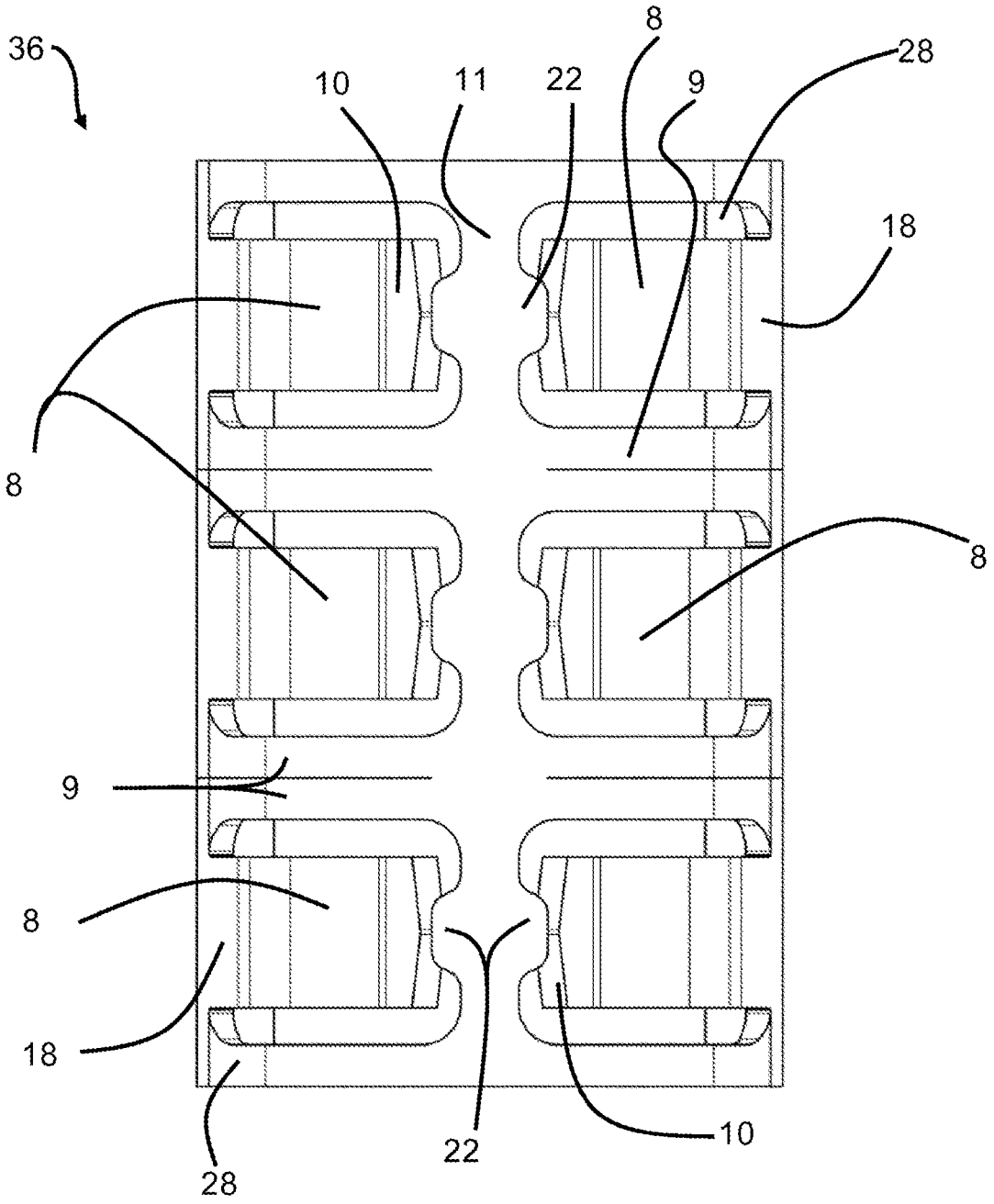
FIG. 15 shows a front view of the contact part from FIGS. 13 and 14.

FIG. 15 shows a view of sheet meta part 36 in FIGS. 13 and 14 with a view of central supporting section 11. It is very clearly apparent that clamping end 10 of clamping springs 8 is arranged at an obtuse angle in a centrally tapering manner. Clamping end 10 of clamping spring 8 thus does not have a straight clamping edge but rather a triangular clamping edge. If an attempt is made to twist out a clamped electric conductor, the latter then slides onto one or the other edge sides of the clamping end, depending on the rotation direction, so that spiral shape tending to lead in the conductor insertion direction results. It is thus difficult to twist out an electric conductor. This specific embodiment of clamping end 10 may be used for each conductor terminal 1, 31 regardless of the number of poles and also regardless of the design of contact element 5 and insulating material housing 2, 32.

It is also clear that two rows of spring clamping connections for electric conductors 15 are provided by opposite clamping springs 8.

Figure 16:
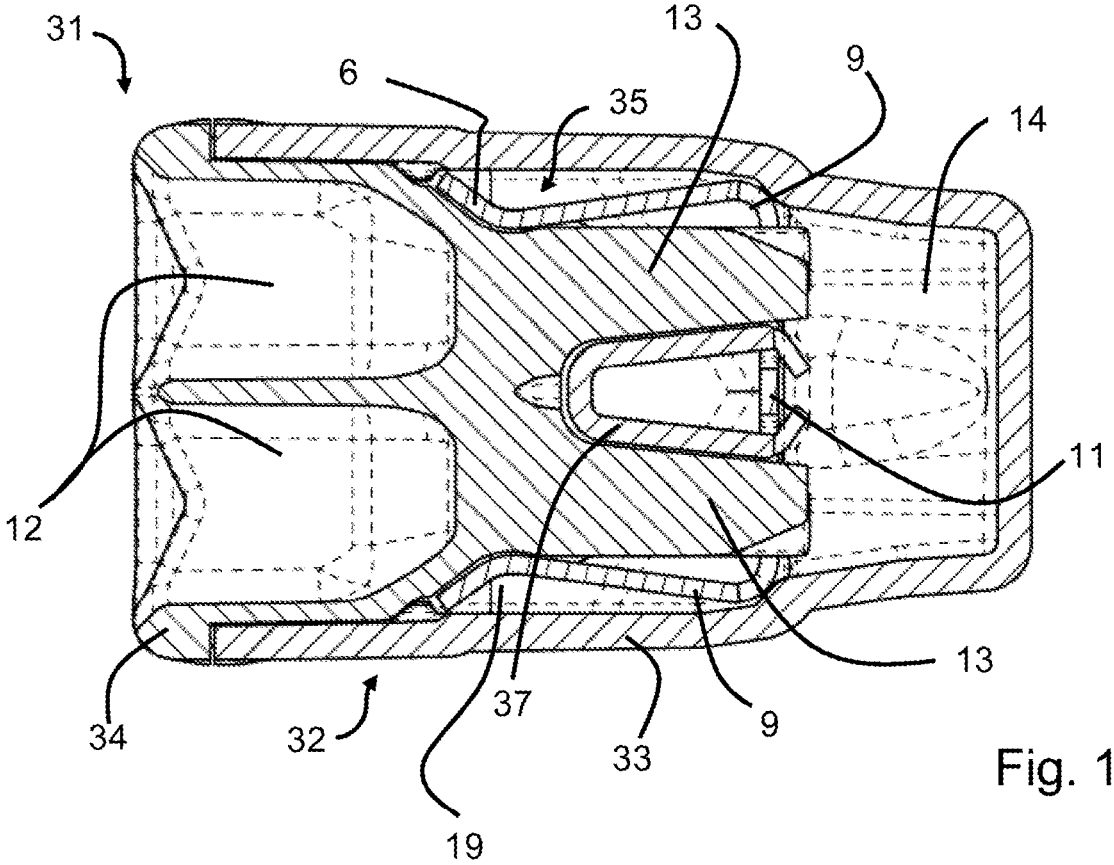
FIG. 16 shows a sectional side view of a two-row embodiment of the conductor terminal, including the contact part from FIGS. 13 through 15.

FIG. 16 shows a sectional side view of a two-row conductor terminal 31 of this type. Insulating material housing 32, in turn, has a two-part design, comprising a housing part 33 and a cover part 34. It is now approximately twice the height of the single-row specific embodiment. It is clear that cover part 34 has two insertion guide channels 12 disposed one above the other and, depending on the number of poles, multiple such side-by-side pairs of insertion guide channels 12.

Channel side walls 13 are again present on cover part 34, which project through the opening in sheet metal part 6.

It is furthermore apparent that busbar 37 in the illustrated exemplary embodiments of a two-row conductor terminal 31 is no longer plate-shaped but is designed as a sheet metal part bent into the shape of a U. This busbar 37 is then built into vertical supporting section 11 in such a way that supporting section 11, including material tabs 22, is surrounded on both sides by busbar 37.

Figure 17:
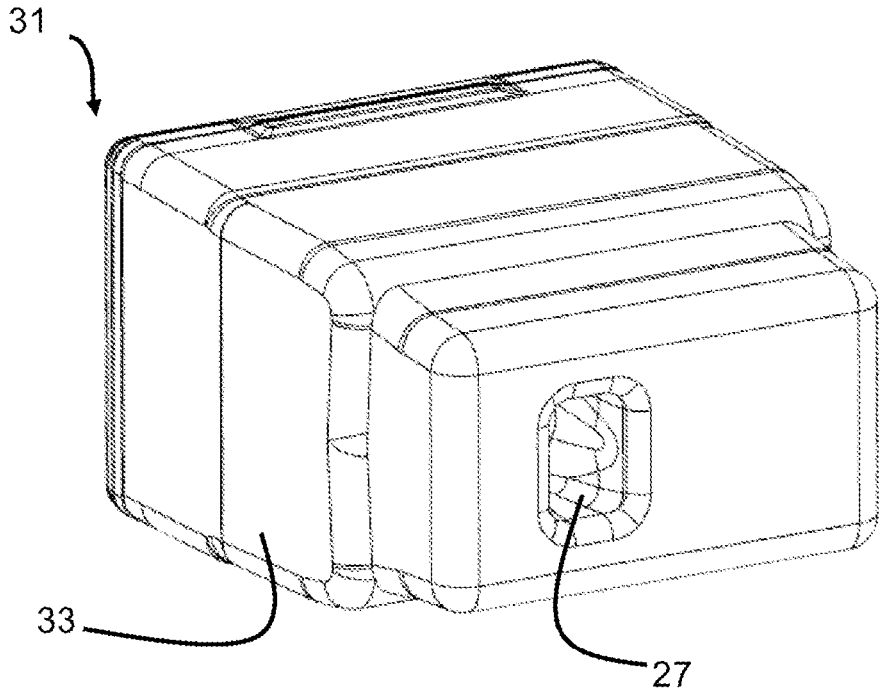
FIG. 17 shows a perspective rear side view of the conductor terminal from FIG. 16.

FIG. 17 shows a rear view of two-row conductor terminal 31 from FIG. 16. It is clear that once again a test opening 27 is present in housing part 33, which leads to sheet metal part 36.

Figure 18:
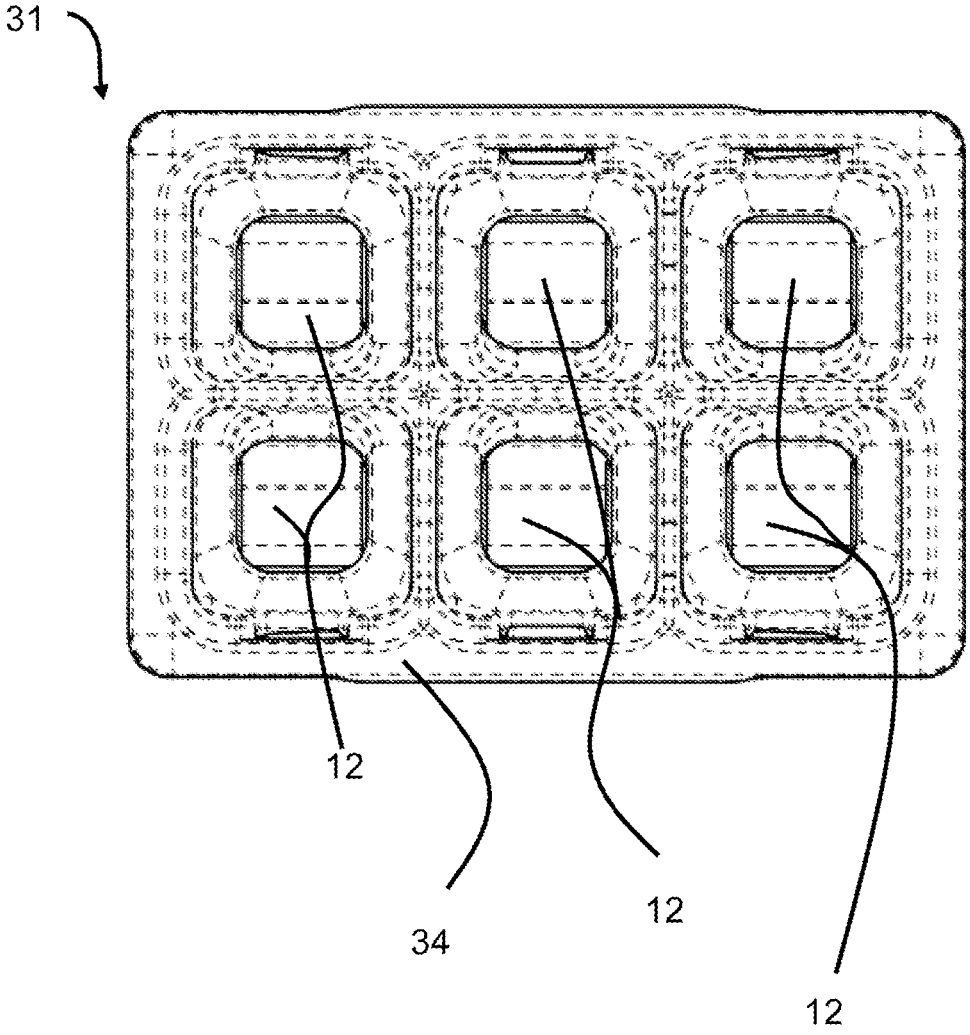
FIG. 18 shows a front view of the conductor terminal from FIG. 16.

FIG. 18 shows a front view of two-row conductor terminal 31 from FIG. 16. It is apparent that multiple insertion guide channels 12 are introduced into cover part 34 consecutively in a row and two such rows of insertion guide channels are introduced therein one above the other. As a result, a six-pole conductor terminal 31, for example, is provided.

However, variants of two-pole, four-pole, eight-pole etc. conductor terminals are also conceivable, i.e. conductor terminals having other integral numbers of poles.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A conductor terminal comprising:

a sheet metal part having a transverse web, a side web and a supporting section; and at least one clamping spring that protrudes from the sheet metal part and is connected to the transverse web of the sheet metal part in a root area of the sheet metal part, wherein, in the root area, the sheet metal part is arched with a groove, a groove base of the groove oriented transversely to a main extension direction of the at least one clamping spring, wherein, along the groove, a first portion of the root area forms a transition from the transverse web to the at least one clamping spring and a second portion of the root area, that is adjacent to the first portion, forms a transition from the transverse web to the side web, and wherein the sheet metal part is arched in the transition from the transverse web to the at least one clamping spring and is arched in the transition from the transverse web to the side web.

2. The conductor terminal according to claim 1, wherein the groove is situated on an outer side of the sheet metal part.

3. The conductor terminal according to claim 1, wherein the at least one clamping spring is formed as a single piece from the material of the sheet metal part, the at least one clamping spring being released from the sheet metal part and being bent away from a plane of the sheet metal part, such that an opening is provided in the plane of the sheet metal part.

4. The conductor terminal according to claim 1, wherein the sheet metal part supports an electrically conductive busbar opposite a free end of the at least one clamping spring.

5. The conductor terminal according to claim 4, wherein the sheet metal part has a multiple of the at least one clamping spring arranged side by side, and wherein the busbar extends in a line-up direction of the multiple of the at least one clamping spring.

6. The conductor terminal according to claim 1, wherein the conductor terminal has an insulating material housing comprising:

a housing part in which the sheet metal part is accommodated; and a cover part which closes the housing part, the cover part having at least one insertion guide channel leading towards the at least one clamping spring.

7. The conductor terminal according to claim 1, wherein the sheet metal part has a first arch, a second arch and a third arch in the root area, wherein the first arch and the second arch protrude in opposite directions from each other and the first arch and the third arch protrude in opposite directions from each other, wherein, in the first portion of the root area, the first arch and the second arch connect the transverse web and the at least one clamping spring and wherein, in the second portion of the root area, the first arch and the third arch connect the transverse web and the side web.

8. The conductor terminal according to claim 1, wherein the side web opposes the supporting section, and wherein, in a non-deflected state of the at least one clamping spring, an entirety of the at least one clamping spring is positioned between the side web and the supporting section.

9. The conductor terminal according to claim 1, wherein an entirety of the side web extends at an angle to the transverse web.

10. A conductor terminal comprising:

a sheet metal part having a transverse web, a side web and a supporting section; and at least one clamping spring that protrudes from the sheet metal part and is connected to the transverse web of the sheet metal part in a first portion of a root area of the sheet metal part, such that the first portion of the root area forms a transition from the transverse web to the at least one clamping spring, wherein a second portion of the root area, that is adjacent to the first portion, forms a transition from the transverse web to the side web, wherein the sheet metal part is arched in the transition from the transverse web to the at least one clamping spring and is arched in the transition from the transverse web to the side web, wherein the sheet metal part has a first arch and a second arch in the root area, and wherein the first arch and the second arch protrude in opposite directions from each other.

11. The conductor terminal according to claim 10, wherein the first arch and the second arch are designed in such a way that, in a non-deflected state of the at least one clamping spring, a main extension direction of the at least one clamping spring is oriented in parallel to a surface of the transverse web of the sheet metal part abutting the root area.

12. The conductor terminal according to claim 11, wherein the main extension direction of the at least one clamping spring is defined by an area of the at least one clamping spring situated in an insertion guide channel between the root area and the supporting section of the sheet metal part.

13. The conductor terminal according to claim 11, wherein the main extension direction of the at least one clamping spring is defined by an area of the at least one clamping spring delimited in an insertion guide channel by the side web and the supporting section of the sheet metal part.

14. The conductor terminal according to claim 10, further comprising a third arch in the root area, wherein the side web and the at least one clamping spring are spaced a distance apart by the first arch, the second arch and the third arch.

15. The conductor terminal according to claim 10, wherein the sheet metal part has a third arch in the root area, wherein the first arch and the third arch protrude in opposite directions from each other, wherein, in the root area, the first arch and the second arch connect the transverse web and the at least one clamping spring and wherein, in the root area, the first arch and the third arch connect the transverse web and the side web.

16. A conductor terminal comprising:

a sheet metal part that includes a transverse web with a root area, a clamping spring and a side web, wherein the clamping spring and the side web protrude from the root area, wherein, in the root area, a first arch and a second arch connect the transverse web and the clamping spring, the first arch and the second arch being oriented to protrude in opposite directions from each other, and wherein, in the root area, the first arch and a third arch connect the transverse web and the side web, the first arch and the third arch being oriented to protrude in opposite directions from each other.

* * * * *